US005199412A

United States Patent [19]

Anliker et al.

[11] Patent Number: 5,199,412

[45] Date of Patent: Apr. 6, 1993

[54] PRODUCTION FACILITY FOR THE MECHANIZED FABRICATION OF MASONRY

[75] Inventors: Markus Anliker; Franz Anliker; Jürgen Anliker, all of Riedlingen, Fed. Rep. of Germany

[73] Assignee: Hedwig Anliker, Riedlingen, Fed. Rep. of Germany

[21] Appl. No.: 693,294

[22] Filed: May 1, 1991

[30] Foreign Application Priority Data

May 7, 1990 [DE] Fed. Rep. of Germany ..... 4014615

[51] Int. Cl.[5] ..... B28D 1/02

[52] U.S. Cl. ..... 125/12; 125/14; 52/749

[58] Field of Search ..... 125/13.01, 14, 24, 12; 52/747, 749, 750

[56] References Cited

U.S. PATENT DOCUMENTS

| | | | |
|---|---|---|---|
| 3,930,929 | 1/1976 | Lingl | 52/749 X |
| 3,936,333 | 2/1976 | Behunin | 52/749 X |
| 4,756,298 | 7/1988 | Spiegelberg | 125/14 |

FOREIGN PATENT DOCUMENTS

| | | |
|---|---|---|
| 253200 | 7/1966 | Austria . |
| 1804233 | 5/1969 | Fed. Rep. of Germany . |
| 2233209 | 1/1974 | Fed. Rep. of Germany . |
| 2253816 | 5/1974 | Fed. Rep. of Germany . |
| 2531957C3 | 1/1977 | Fed. Rep. of Germany . |
| 3313731C2 | 5/1984 | Fed. Rep. of Germany . |
| 3520788A1 | 12/1986 | Fed. Rep. of Germany . |
| 3712847A1 | 4/1987 | Fed. Rep. of Germany . |

*Primary Examiner*—James G. Smith

*Attorney, Agent, or Firm*—Spencer, Frank & Schneider

[57] ABSTRACT

A production facility for the mechanized fabrication of masonry includes a turnover table (6) which receives a plurality of building stones (12) intended for a building-stone course of a wall that is to be produced. The turnover table (6) secures the building stones (12) in place, pivots them together about a horizontal axis (4) running at a distance parallel to the wall (1) to be produced, and transposes them with the top side down. The turnover table (6) can be loaded quickly by a belt (9) and another turnover table (7) for transposing the building-stone course in one piece from the conveyor belt (9) to the other turnover table (6). As a result of the increased output thus effected, the production facility can be integrated into a factory having a plurality of finishing stations for further production stages.

8 Claims, 4 Drawing Sheets

PRODUCTION FACILITY FOR THE MECHANIZED FABRICATION OF MASONRY

BACKGROUND OF THE INVENTION

The invention relates to a plant or production facility for the mechanized fabrication of masonry, having a turnover device which receives a plurality of building stones that are intended for a building-stone course, and while taking into account mutual distances apart, secures them in place, pivots them together about a horizontal axis running at a distance parallel to the wall to be produced and transposes them with the top side down.

German Patent 3,520,788 discloses a turnover device of this type. This single device is essentially loaded manually. By means of a special lifting tackle, the worker picks up the building stones individually from the delivered pallet and joins the building-stone row together on the turnover table serving as a turnover device. If openings in the masonry are to be provided, the distances between the stones are measured. Other stones, in each case following the laying plan, are shortened by means of a stone-cutting saw. A disadvantage here is that the turnover table must be stopped during the time required for joining the building-stone course together; the time required for transposing a building-stone row is composed of the joining time plus the turnover and displacing time.

Furthermore, for the purpose of partial automation, it is known from the abovementioned patent specification to join the building-stone course together on the turnover table itself by means of a roller conveyor conveying in the longitudinal direction. Although this may shorten the joining time, nothing changes the fact that the times for the movement of the turnover table have to be added thereto in order to obtain the total time for transposing a building-stone course.

SUMMARY OF THE INVENTION

The object of the invention is to speed up the production of masonry panels with such a device and in addition to provide a plant for the efficient further processing of the finished masonry panels.

Starting from a production facility of the type designated at the beginning, this object. is achieved according to the invention in that a stationary device for joining together the building-stone course and a transfer device for transposing the prepared building-stone course in one piece to the turnover device are provided. Consequently, the joining and transposing are non-interactive with regard to timing, i.e. the corresponding devices can work at least partly simultaneously, which increases their utilization factor and increases the output of the plant.

It is proposed that the transfer device be integrated into the turnover device by the latter being designed as a clamping frame which comes down from above around the prepared building-stone course. In this case, the frame takes the place of the turnover table on which the building stones have to be laid. In contrast, the frame can receive the building stones at its underside and deliver them at its topside, which lies at the bottom in the turned-over state. In this arrangement, it may be necessary to mount the clamping frame in a displaceable and driveable manner inside the supporting construction which connects it to the turnover shaft.

Another preferred embodiment of the transfer device consists in this transfer device being a vertically displaceable turnover table which is equipped with clamping devices and which receives the prepared building-stone course, pivots it and pivots it back after the correct height is set, and deposits it on a second turnover table which in turn constructs the wall. Here, the device for joining together the building-stone course is preferably arranged in such a way that it is located beneath the second turnover table located in the loading position. The axis of the first turnover table extends and moves in a plane parallel to the wall to be produced, which, however, is further away from this wall than the axis of the second turnover table. The turnover tables are controlled in such a way that the first turnover table receiving the building-stone course is first of all pivoted out of the area of movement of the second turnover table. The first turnover table then travels up or the second turnover table travels down so far that the transfer of the building-stone course can take place.

The device for joining together the building-stone course preferably comprises a conveyor belt program-controlled in steps and a program-controlled stone depositing means which picks up the building stones one after the other from a supply and deposits them in the same position always at the same location on the conveyor belt. The conveyor belt in each case then travels one stone length or one additional length further if an opening in the masonry is to be formed.

To avoid manual work in connection with the sawing of building stones, it is furthermore proposed that a stone-cutting saw displaceable in the length of the building stone in a program-controlled manner be provided in order to shorten if necessary a building stone deposited on the conveyor belt. In particular, the building stone to be shortened is conveyed by means of a turnover device from the conveyor belt to the stone-cutting saw and back again, the sawn-off and unwanted part of the building stone being ejected laterally. All these operations can be controlled by means of drive devices known per se according to an individual program which is drawn up with reference to the building plan in the course of job planning.

A progressive and decisive efficiency measure in this prefabricated-unit method of construction, which can be planned individually, consists in the wall panels being erected on transport cars which can be conveyed in a circular course through a plurality of finishing stations. It is advantageous if the transport cars can be turned carousel-like through 180° so that two parallel walls can be erected thereon by means of a stationary wall machine. In a first finishing station the walls should be provided with the requisite transport scaffolds or suspension reinforcement. At further finishing stations the individual constructional features are to be considered, for example the insertion of windows, the fitting of parts of the electrical and water installation, the rendering of the wall surfaces, the fitting of shutters and the like. Substantial savings in working time are thereby made, since the fitters do not have to travel to varying places of work. The transport of material is dispensed with, since the material stores are provided along the circular course of the transport cars. The working conditions are substantially better, since heavy manual work is dispensed with, the risk of accident is reduced and the environmental conditions (heated hall) can be better. Nonetheless, the previous individual building system, i.e. the individual planning and the use of various wall thicknesses and building stones can be retained by the proposed plant.

BRIEF DESCRIPTION OF THE DRAWINGS

An exemplary embodiment of the invention is explained below with reference to schematic drawings, in which, specifically.

DESCRIPTION OF THE PREFERRED EMBODIMENT

Figure 1:
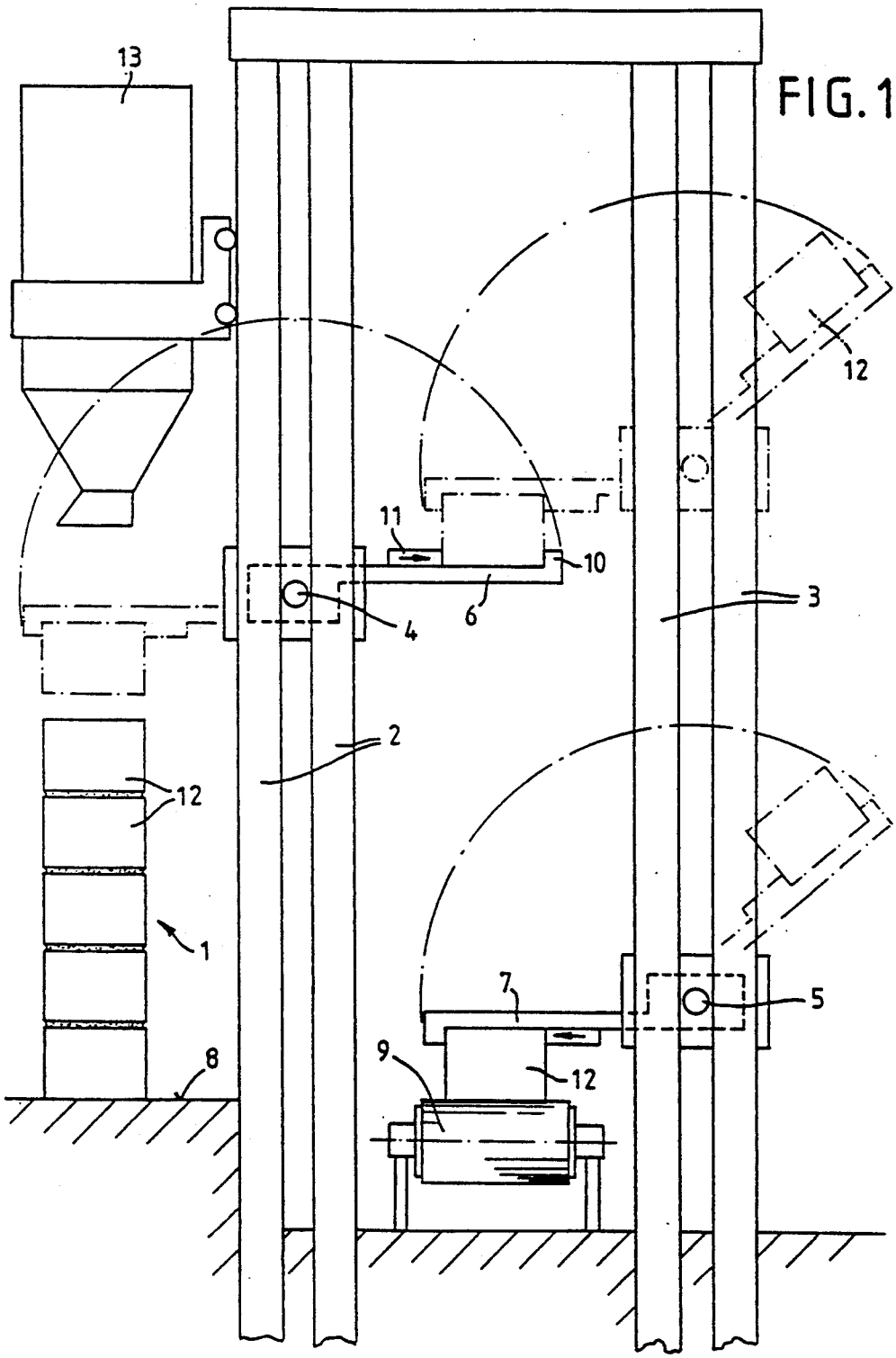
FIG. 1 shows the view of a production facility for producing masonry in a narrow sense, having one device each for joining together, transferring and transposing the building stones, viewed in the axial direction or the longitudinal direction of the wall.

FIG. 1 shows, in end elevation, on the left a wall panel 1 which has been started and to the right of it two double pillars 2 and 3 which are part of two portal structures in which the horizontal shafts 4 and 5 of two turnover tables 6 and 7 are accommodated in a vertically adjustable and rotatable manner. The individual travelling and pivot drives of the turnover tables are not shown. A horizontal conveyor belt 9 which, like the shafts 4 and 5, extends parallel to the wall panel 1, is located between the double pillars 2 and 3 and vertically below the wall bearing surface 8, which according to FIG. 4 can be designed as a transport car. The turnover tables 6 and 7 have schematically indicated clamping devices, each consisting of a stop strip 10 fastened to the turnover table and radially movable clamping strips 11 which secure a number of building stones 12 in a reclining or suspended position on the relevant turnover table, which building stones 12 are laid one behind the other and form a building-stone course to be transposed in one piece. Finally, FIG. 1 also shows a mortar dispenser 13 travelling back and forth at a desired height above the crest of the wall.

Figure 2:
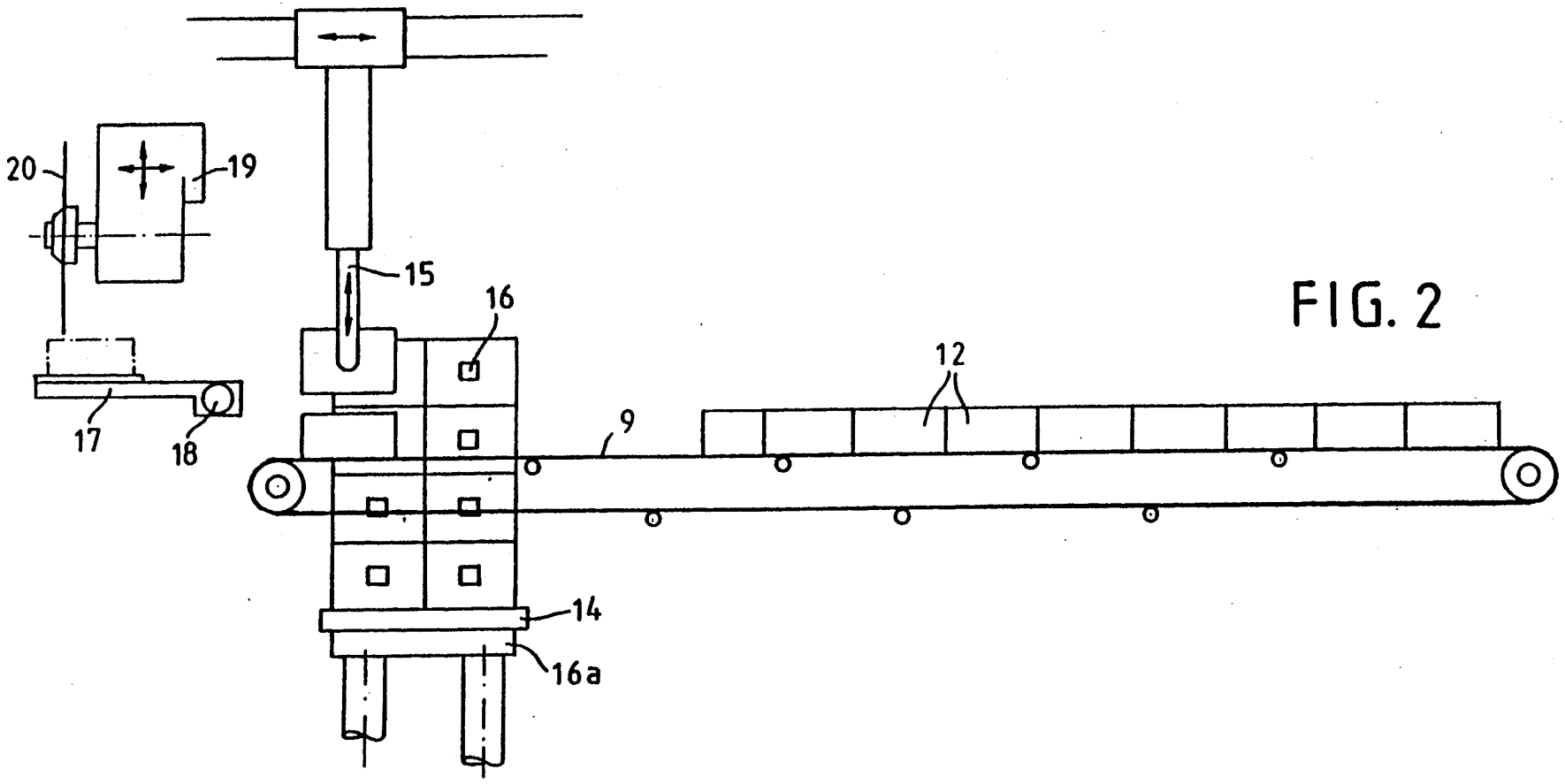
FIG. 2 shows, on a smaller scale, a side view of the device for joining together the building stones according to FIG. 1 including a feed device and a stone-cutting saw, without the turnover tables.
Figure 3:
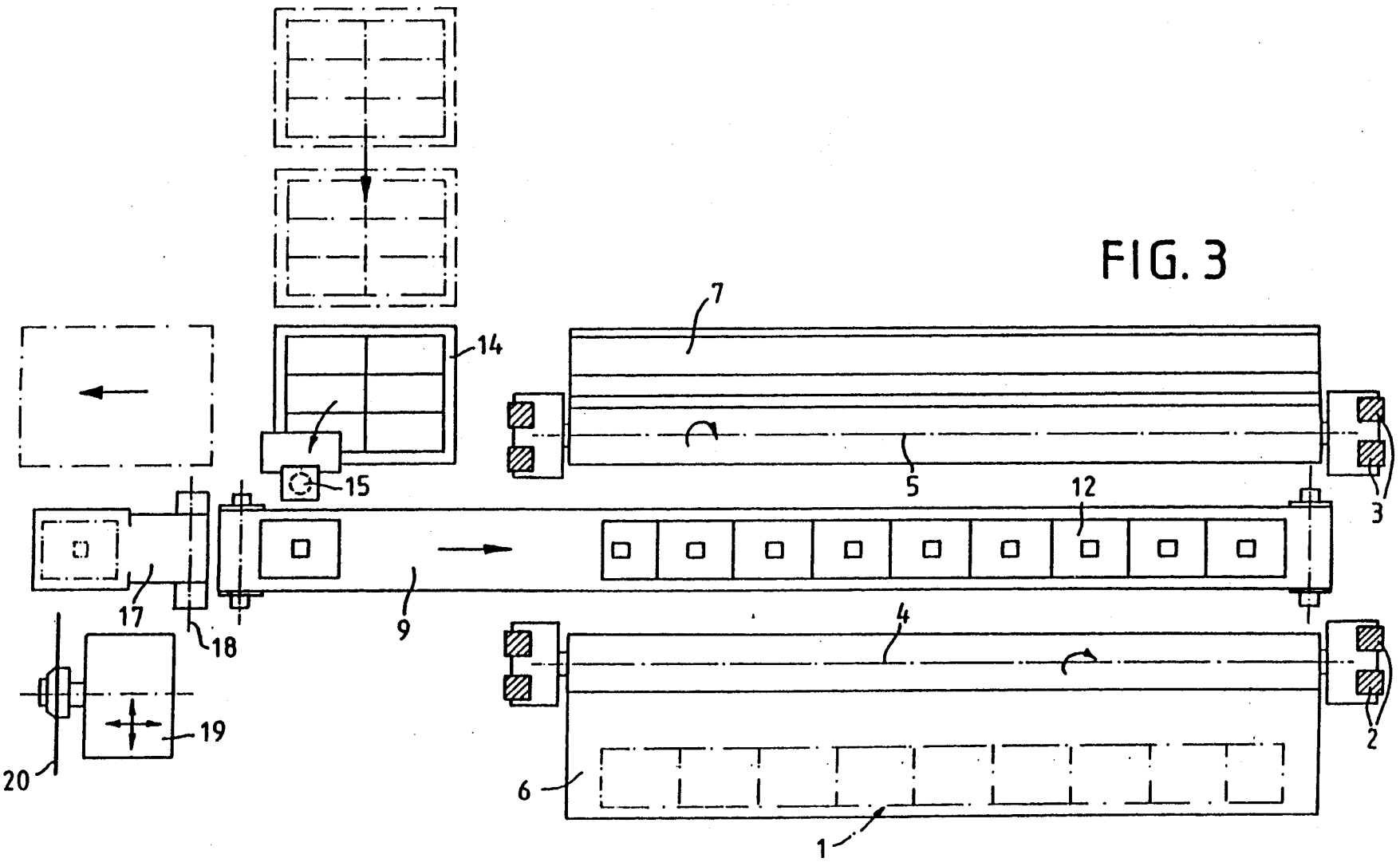
FIG. 3 shows a plan view of the arrangement according to FIG. 2.

FIGS. 2 and 3 show in particular the joining device for the building-stone course. Its base is formed by the conveyor belt 9, which is recognizably longer than the turnover tables and wall panel to be produced. Next to the conveyor belt at the front end of the wall panel 1 is the place for putting a pallet 14, from which the delivered building stones are removed by means of a gripper 15 and are laid individually at the front on the conveyor belt 9. The gripper works likes a robot with fully automatic, electronic control, which is possible in so far as each pallet nonetheless contains the same number of building stones in the same arrangement. The building stones are preferably tall perforated bricks which have at least one larger opening 16 in the extruding direction, into which opening 16 the gripper pushes and opens out. The building stone is then turned through 90° by the gripper and placed with the opening 16 at the top onto the conveyor belt 9.

In order to minimize the displacements of the gripper 15, provision is made for the pallet to lie on a lifting table 16*a* which, after clearing one building-stone course in each case, travels up by the height of one building stone. The full pallets are conveyed forward on one side and the empty pallets are removed at right angles thereto.

Located to the left in extension of the conveyor belt 9 is a smaller turnover device having a turnover table 17 and a horizontal shaft 18 running transversely to the conveyor belt 9. This turnover device, if provided for in the building plan, serves to remove a building stone from the place where it is laid at the start of the conveyor belt and, after turning over through 180°, to move it into the area of a stone-cutting saw 19, whose saw blade is designated by 20. The feed direction of the stone-cutting saw during sawing runs transversely to the conveyor belt. On the other hand, the entire saw can be displaced in the direction of the conveyor belt by precisely determinable lengths in a program-controlled manner on an appropriate slide. The clamping devices (not shown) on the turnover table 17 move transversely to the conveyor belt, that is, in the direction of the turnover shaft 18. In this way, after the sawing operation, the shortened stone remaining can be reliably held in place irrespective of its length and put back onto the conveyor belt 9 again. During the sawing, however, the building stone must additionally be held in place on the turnover table 17 in such a way that the saw blade is not impaired. In addition, the abovementioned clamping device must dip down out of the way. A further device (not shown) pushes the cut-off and unwanted part of the building stone from the turnover table 17 and conveys it away.

After a complete or sawn-off building stone has been finally laid on the conveyor belt 9, the latter each time moves gradually so far to the right that the planned building-stone course forms, with or without a gap for the intended wall opening. Once the building-stone course is complete, the conveyor belt travels a slight distance further and brings it into the gripping area of the turnover table 7.

In summary, the following working sequence is obtained the first building-stone course joined together on the conveyor belt 9 is received by the turnover table 7 by the latter pivoting to the left and coming down on the building-stone course, whereupon its clamping device 10, 11 closes. The turnover table 7 then in any case pivots so far to the right and travels up so far that the turnover table 6 can pivot into its right hand position in which its receiving surface is turned over to the top, and can if need be travel down a slight distance. The conveyor belt 9 is meanwhile reloaded immediately after reaching its unloading position. When the turnover table 6 has reached the position reproduced in solid lines and the turnover table 7 is next to it in a position which is higher by the height of one building stone, the transfer can take place. For this purpose, the turnover table 7 pivots to the left and deposits the building-stone course on the turnover table 6. The clamping device of the turnover table 6 closes and that of the turnover table 7 opens. As soon as the turnover table 7 has pivoted back again to the right, the turnover table 6 pivots through 180° to the left and travels down so far that the suspended building-stone course is deposited on the bearing surface 8. If need be, a mortar bed has been prepared on this bearing surface beforehand by means of the mortar dispenser 13. The turnover table 6 then pivots back again through 180° and travels up so far that the turnover table 7, which has in the meantime travelled down, can fetch the next building-stone course, in the meantime joined together, without hinderance.

Thus the building stones are transposed course by course until the wall panel 1 is finished and can be transported away. Accurate program control of the individual sequences of movement ensures their timed coordination and guarantees working of all components free of interruption, which ultimately leads to an exceptionally high production rate.

The program also determines the height at which the transfer of the building-block course from the turnover table 7 to the turnover table 6 is to take place. This can be an unchanged position at an average height as indicated in FIG. 1. But the transfer can also take place at a different height in each case, so that, after the transfer, the turnover table 6 does not have to cover a larger travelling distance in the vertical direction in order to transpose the building-stone row to the wall.

Figure 4:
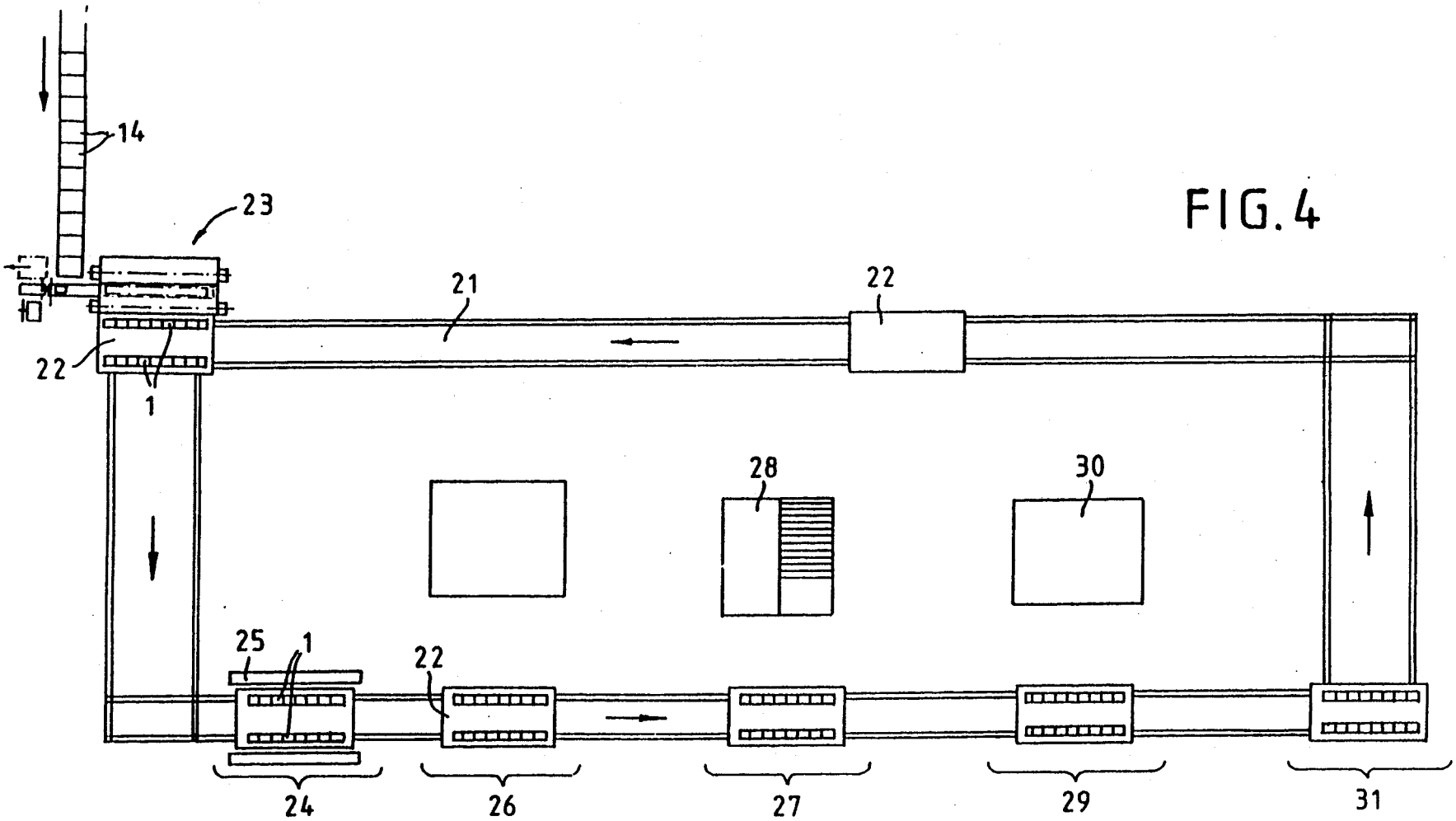
FIG. 4 shows, on a smaller scale, a ground plan of an entire plant, extended by the finishing stations, for producing masonry.

The expanded production plant according to FIG. 4 has a rectangular track layout 21 which individual transport cars 22 travel on preferably so as to circulate in the direction of the arrow. The wheels of the transport cars can be pivoted about vertical axes and are pivoted through 90° during the transfer from the narrow sides of the rectangle to the longitudinal sides or vice versa. In addition, the supporting tables of the transport cars 22 can be pivoted carousel-like on the base frames between two opposite positions. In this way, it is possible to erect two wall panels on on one transport car 22 by means of the wall-production facility designated overall in this figure by 23. Since this plant is stationary, the transport car 22 is moved away a slight distance after completion of the first wall panel and moved up to the plant again after rotation of the table through 180°. The adjoining track section having a large gauge serves as storage space for a plurality of transport cars having finished wall panels.

A plurality of stations now follow along the further circular course, in which stations the wall panels attain higher prefabrication stages. In a first station 24, vertical reinforcing bars are put in and cast in concrete, which reinforcing bars ensure the transportability of the wall panel and, for example, present fastening points for the crane hooks. Here, as at the further stations, stationary work scaffolds 25 can be provided in order to facilitate the work. In the next station 26, the concrete chords required in some wall panels are applied. The store for the formwork required for this is adjacent station 26. In the third station, windows are inserted and, as far as necessary, electrical and sanitary installations are fitted. A window store is designated by 28. In the fourth station 29, the wall surfaces are rendered, in particular plastered, for which purpose the wall panel is advantageously put into a horizontal position. The receiving and pivoting tables required for this can be provided in this station. A plaster store is designated by 30. Finally, in this example, the shutters are fitted in a fifth station 31.

The transport cars 22 are then either brought out of the circular course to a finished store or are emptied in an unloading station (not shown) and prepared for receiving further wall panels. These empty cars are then fed again to the wall-producing plant 23.

We claim:

1. A production facility for the mechanized fabrication of masonry, comprising:

first transfer means for moving a row of building stones in unison from a first position to another position that is spaced apart from the first position; and second transfer means for receiving the row of building stones from the first transfer means at the another position, pivoting the row of building stones about a horizontal axis which is parallel to a wall that is being fabricated and which is spaced apart from the wall that is being fabricated, and for depositing the row of building stones upside down as a building stone course of the wall that is being fabricated, wherein the first transfer means comprises a pivotally mounted frame which comes down from above the building stone row at the first position.

2. A production facility according to claim 1, further comprising a transport car (22) to support the wall that is being fabricated, a plurality of finishing stations (24, 26, 27, 29, 30), and a closed course (21) along which the transport car is moved after the wall has been fabricated, the finishing stations being disposed adjacent the closed course.

3. A production facility for the mechanized fabrication of masonry, comprising:

first transfer means for moving a row of building stones in unison from a first position to another position that is spaced apart from the first position; and second transfer means for receiving the row of building stones from the first transfer means at the another position, pivoting the row of building stones about a horizontal axis which is parallel to a wall that is being fabricated and which is spaced apart from the wall that is being fabricated, and for depositing the row of building stones upside down as a building stone course of the wall that is being fabricated, wherein the first transfer means comprises a pivotally mounted and vertically displaceable turnover table (7) which is equipped with clamping devices (10, 11) and which receives the building stone row at the first position, pivots it and pivots it back after the turnover table has been raised, and deposits the row on the second transfer means at the another position.

4. A production facility for the mechanized fabricated of masonry, comprising:

row-forming means for receiving a plurality of building stones and for arranging the building stones in a row at a first position;

first transfer means for moving a row of building stones in unison from a first position to another position that is spaced apart from the first position; and second transfer means for receiving the row of building stones from the first transfer means at the another position, pivoting the row of building stones about a horizontal axis which is parallel to a wall that is being fabricated and which is spaced apart from the wall that is being fabricated, and for depositing the row of building stones upside down as a building stone course of the wall that is being fabricated, wherein the first transfer means comprises a conveyor belt (9) program-controlled in steps and a stone depositing means (15) which picks up the building stones (12) one after the other from a supply (14) and deposits them in the same position and at the same location on the conveyor belt (9).

5. A production facility according to claim 4, further comprising a stone-cutting saw (19) displaceable in the longitudinal direction of a building stone in a program-controlled manner in order to shorten if necessary a building stone deposited on the conveyor belt (9), the stone-cutting saw being disposed adjacent the stone depositing means.

6. A production facility according to claim 5, further comprising a turnover device to convey a building stone to be shortened from the conveyor belt (9) to the stone-cutting saw (19) and back again.

7. A production facility for the mechanized fabrication of masonry, comprising:

first transfer means for moving a row of building stones in unison from a first position to another position that is spaced apart from the first position; and second transfer means for receiving the row of building stones from the first transfer means at the another position, pivoting the row of building stones about a horizontal axis which is parallel to a wall that is being fabricated and which is spaced apart from the wall that is being fabricated, and for depositing the row of building stones upside down as a building stone course of the wall that is being fabricated, wherein the first transfer means comprises means for pivoting the row of building stones about a horizontal axis which is parallel to the wall that is being fabricated and which is spaced apart from the wall that is being fabricated.

8. A production facility according to claim 7, further comprising row-forming means for receiving a plurality of building stones and for arranging the building stones in a row at the first position.

* * * * *